United States Patent [19]

Barbieri

[11] 4,124,923

[45] Nov. 14, 1978

[54] APPARATUS FOR TEXTURING YARN AND TEXTILE FABRIC CONTAINING SYNTHETIC FIBERS

[75] Inventor: Enrico Barbieri, Brescia, Italy

[73] Assignee: Advanced Textiles Exploitation AG, Vadug, Liechtenstein

[21] Appl. No.: 821,519

[22] Filed: Aug. 3, 1977

[30] Foreign Application Priority Data

Sep. 3, 1976 [IT] Italy ..... 5202 A/76

[51] Int. Cl.[2] ..... D02G 1/00; D06B 1/06; D06B 9/00

[52] U.S. Cl. ..... 26/18.5; 28/281; 68/18 C; 68/205 R; 118/DIG. 4

[58] Field of Search ..... 26/18.5; 28/281; 68/18 C, 205 R; 118/DIG. 4

[56] References Cited

U.S. PATENT DOCUMENTS

| | | | |
|---|---|---|---|
| 2,052,948 | 9/1936 | Simpson | 26/18.5 |
| 3,579,679 | 5/1971 | Willis | 68/205 R X |
| 3,593,543 | 7/1971 | Bergman | 68/18 C X |
| 3,640,099 | 2/1972 | Holm | 68/205 R X |
| 3,730,679 | 5/1973 | Schuierer | 68/205 R X |
| 3,750,428 | 8/1973 | Bruckner | 68/205 R X |
| 3,803,879 | 4/1974 | Holm | 68/205 R X |
| 3,828,587 | 8/1974 | Holm | 68/205 R X |

FOREIGN PATENT DOCUMENTS

| | | | |
|---|---|---|---|
| 363,775 | 2/1973 | U.S.S.R. | 118/DIG. 4 |

*Primary Examiner*—Robert R. Mackey

[57] ABSTRACT

An apparatus for texturizing yarn or woven fabric while recovering partially the heat energy employed in the process. It consists of a texturizing chamber, a plurality of containers for liquid vehicles at different temperatures, means for introducing, conveying and removing a material to be texturized, and means for introducing, impurging, removing and recycling the liquid.

12 Claims, 8 Drawing Figures

APPARATUS FOR TEXTURING YARN AND TEXTILE FABRIC CONTAINING SYNTHETIC FIBERS

The present invention relates to apparatus for texturing yarn and textile fabrics containing synthetic, thermo-sensitive fibers.

In the field of texturization of yarn containing synthetic thermo-sensitive fibers, known and conventional methods involve yarn treatments wherein the yarn is subjected to heating by means of electrical resistors or of heated cylinders, and is eventually subsequently subjected to an immediately subsequent cooling by means, for example, of air-cooled cylinders. In any event, these well-known methods require a considerable consumption of energy, due to the heat-input and heat-removal requirements, said energy being totally unrecoverable and, thus, contributing notably to the overall cost of the texturing treatment.

It is, therefore, an object of the present invention to overcome the prior methods drawbacks by providing an apparatus which permits the texturizing to be effected by employing the same liquid vehicle as heating and cooling medium in the treating process, said liquid vehicle being, furthermore, fully recoverable and recyclable in a consequently advantageous partial exploitation of its heat energy.

It is another object of the invention to provide an apparatus equally suitable for pre-treating thermosensitive yarn prior to their being woven, and for treating already woven textile fabrics, in either case there being obtained a satisfactory, permanent texturization at a production rate and production yield quite remarkable.

It is to be observed that by the term "liquid vehicle", as used throughout the specification, it is meant an organic compound or an organic solution, such as polyalkylene glycol, suitable for the type of thermo-sensitive fibers to be treated. Similarly, by the term "thermo-sensitive fibers" contained in the yarn and/or in the woven fabric, it is meant those fibers fully or partly consisting of polyesters, polyamides, polyethylenes or equivalent thermoplastic materials employed in the textile industry.

Briefly stated, these and other objects and advantages of the invention are achieved with an apparatus which comprises a treating chamber with inlet and outlet ports, there being located between said ports: first cooling means for condensing the vapors generated within said chamber; at least a pair of rollers for the forward advancing of the material to be treated; an endless horizontal belt conveyor for carrying and displacing the material to be treated; at least one first container for delivering on the material and discharging therefrom a hot liquid vehicle during the time in which the material is transferred by the rollers to the endless belt; at least one second container for delivering on the material a cold liquid vehicle for precooling the material while this is being displaced by the moving endless belt conveyor; a third container, with a plurality of discharge outlets, for delivering a cold liquid vehicle onto and through the material while this is moving on the endless belt conveyor; and means for transporting the material being treated toward the outlet or discharge port of the chamber, at which location there is provided second cooling means for condensing vapors and preventing their exiting from the chamber in the gaseous state.

The construction of the apparatus of the invention will become evident from the following detailed description thereof, with reference to the accompanying drawings, in which.

Figure 1:
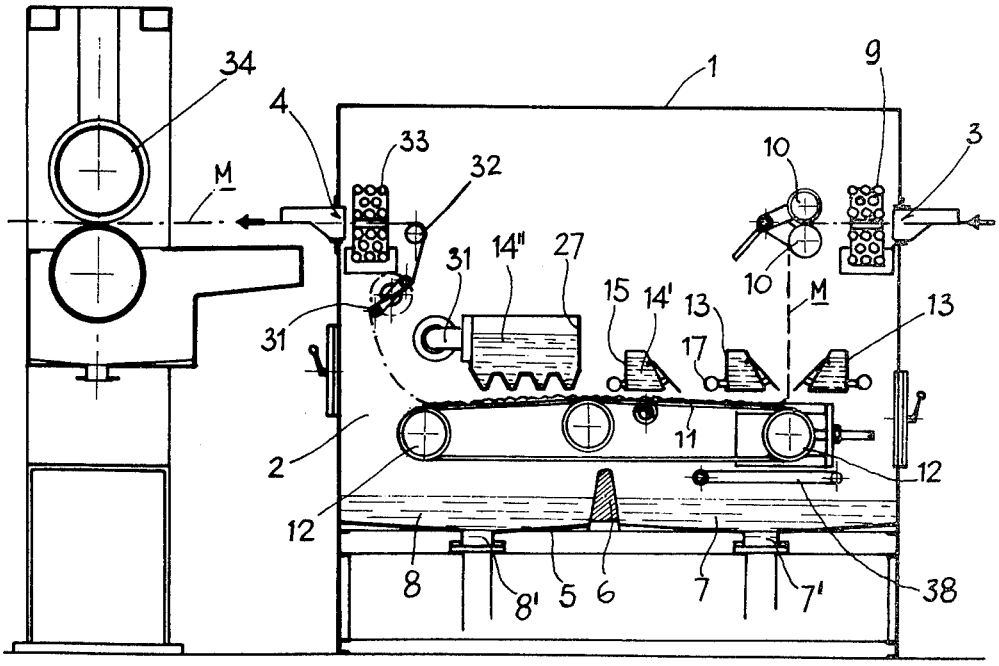
FIG. 1 is a sectional, longitudinal and elevational view of the overall schematic apparatus of the invention, with reference to texturization of yarn.

Referring now to the drawings, the chamber 2, defined structurally by its borders 1, is provided with an inlet port 3 and an outlet port 4 for the yarn or fabric M to be texturized in the chamber. A floor 5 is provided in the chamber with a transverse and intermediate partition 6 which defines a pair of containers 7 and 8. These containers have respective drains or discharges 7' and 8' for discharging the hot liquid vehicle and the cold liquid vehicle, respectively.

Within chamber 2 and in front of the inlet port 3 there is provided a battery of tube condensers 9, suitably fed with a cooling fluid. Facing the condenser 9 and aligned therewith, there is at least a pair of rollers 10 for advancing the material M from its entrance port to its exit port.

In the chamber 2, on a lower plane with respect to the ports 3 and 4, there is provided an endless belt conveyor 11 which is moved by means of rollers 12 and serves the purpose of displacing the material M during the phase of texturization.

When yarn is to be treated (see FIG. 1), the yarn passes from rollers 10 to the endless belt conveyor 11 simply by gravity. Immediately above the region where the yarn contacts the belt conveyor 11, there are positioned two first containers 13, facing each other and on opposed sides of the falling yarn. These containers converge onto the yarn two opposed jets of hot liquid vehicle 14, such as polyalkylene glycol, which jets heat uniformly the yarn.

Downstream from the containers 13, there is positioned a second container 15 for delivery onto the yarn M and discharge therefrom, as the yarn is being displaced by the belt conveyor 11, of a pre-cooling liquid vehicle 14'. This vehicle is the same as vehicle 14 but is at a lower temperature with respect thereto.

For example, the temperature of vehicle 14 in the containers 13 for heating the yarn M may vary between about 150° C and 20° C, depending on the type of fiber to be treated. Conversely, the temperature of the vehicle 14' in the container 15 may vary between about 30° C and about 45° C, depending on the degree of precooling desired.

Both the first containers 13 and the second container 15 are in fluid communication with the bottom container 7 of the chamber, so that the heating vehicle 14 and the pre-cooling vehicle 14', which are not absorbed by the yarn M, collect into the bottom container 7 and are removed for recycling through the drain port 7'.

It is to be noted that the vehicle 14' delivered by the second container 15, besides effecting a pre-cooling of the yarn, is so controlled as to complete the quantity of liquid absorbed by and removed from the yarn during its displacement on the belt conveyor, and thus to maintain an equilibrium between the quantity of hot vehicle delivered by the first containers 13 and the quantity of vehicle removed through the drain port 7'.

On the other hand, the pre-cooling vehicle 14', passing through the heated yarn M, removes therefrom a part of the heat energy and becomes subjected to a pre-heating step prior to its being passed to the heating means and subsequently recycled to the first containers 13. Hence, it is evident that there is a full recovery of the vehicle and a partial recovery of the heat energy by the pre-cooling vehicle for reuse in the containers 13.

Figure 3:
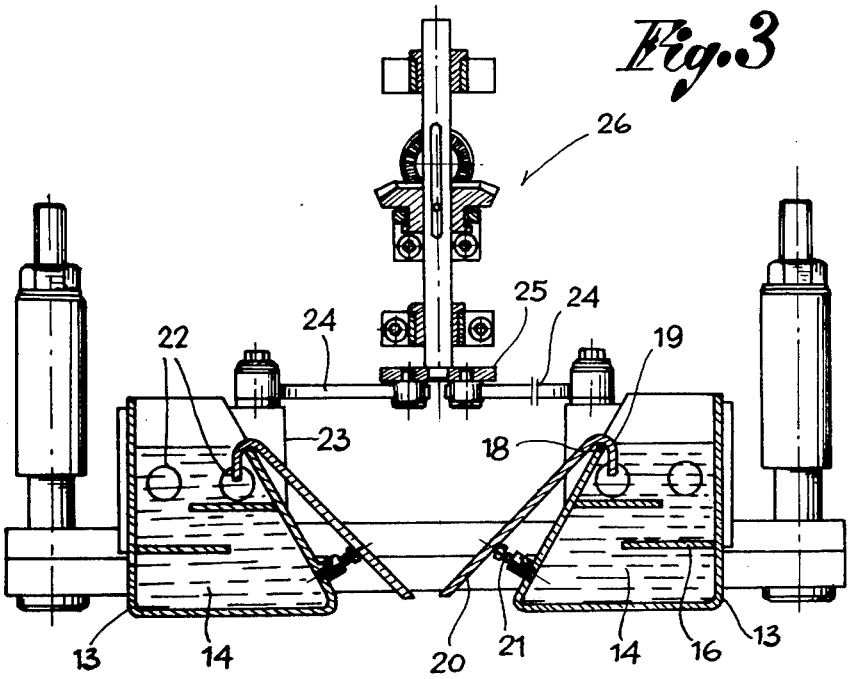
FIG. 3 is a transverse sectional view of a pair of adjustably coupled containers for delivery of the liquid vehicle onto the material to be treated.

Each container, be it the containers 13 or the container 15, comprises a sectionalized channel-like body (see FIG. 3) which preferably becomes narrower in the upward direction. For this body, there is fixedly positioned a number of break-water partitions 16. Each container is provided on one side with a feed pipe 17 and on the longitudinally opposite side with a drop-off 18, on the edge of which there simply rests thereupon the curved extremity 19 of an inclined plate 20. The angle of inclination of plate 20 may vary and is regulable.

Substantially, therefore, each inclined plate 20 is articulated on the edge of the drop-off 18 and is in contact with fasteners 21, such as a regulating screw, mounted on the container on the side of the drop-off 18. This fastener serves to regulate the angle of inclination of the plate 20, so that it is possible to regulate the direction of the liquid vehicle exiting the container, which vehicle flows down the inclined plate 20 and impinges upon the yarn M in a direction from angular to normal with respect to the direction of movement thereof.

Figure 4:
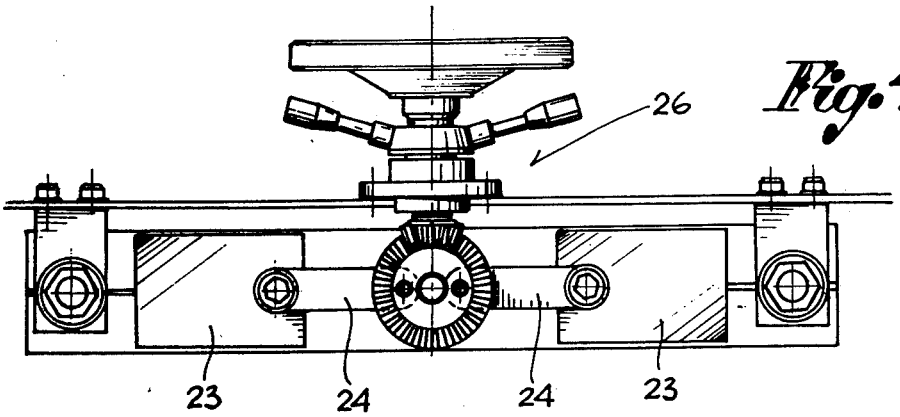
FIG. 4 is an external view of the means for positioning the containers of FIG. 3.
Figure 5:
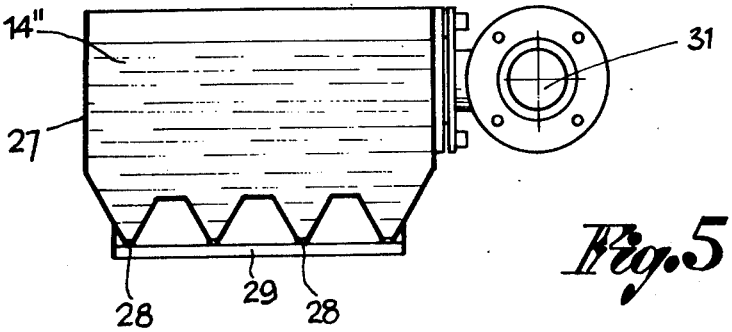
FIG. 5 is a sectional view of a container for delivery of the cold liquid vehicle.

Furthermore, while the second container 15 is stationary, the first containers 13, which are facing each other, are mounted on sliding supports 23 by means of terminal pivots 22, so as to be movable toward and away from each other in parallel fashion and also with respect to the yarn M which passes therebetween. To effect this regulated displacement, the sliding supports 23 are attached to a pair of pullers 24 (see FIGS. 3 and 4) eccentrically pivoted on a disc 25. Disc 25 is partially rotated in one direction or in the other by means of a suitable, manually operated, geared transmission, generally shown at 26, and located externally of the treating chamber 2. Downstream from the second container 15 and above the belt conveyor 11, there is provided a third container 27, positioned transversely to the motion of the yarn M, and containing a liquid vehicle 14''. Vehicle 14'' is fed thereto by a conduit 31 and is the same as hot vehicle 14 but is at a temperature substantially equal to that of vehicle 14' in container 15, that is, at between about 30° C and about 45° C. Vehicle 14'' serves to further cool the texturized yarn M.

Figure 6:
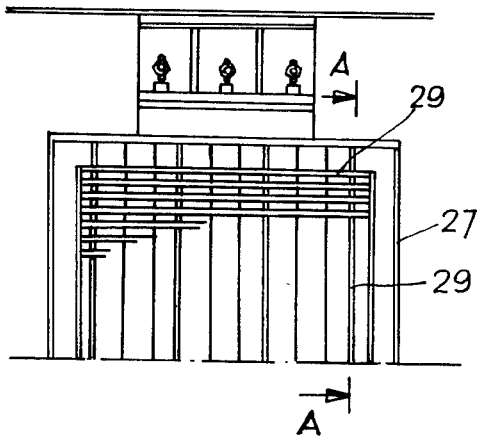
FIG. 6 is a detailed view of the bottom of the container of FIG. 5.
Figure 7:
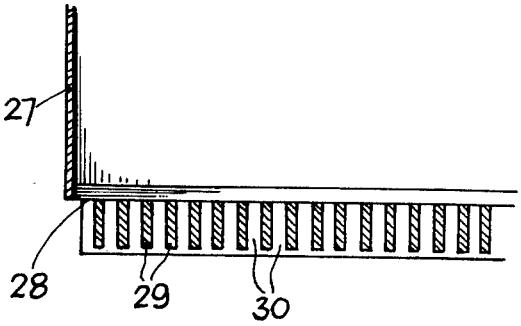
FIG. 7 is a sectional view of the container of FIG. 6 taken in the direction of arrows A—A.

Container 27 has a plurality of longitudinal bottom discharge ports 28, beneath which there is provided a plurality of distributing blades 29 oriented normally to the discharge ports 28 and parallel to one another (see FIGS. 6 and 7). These blades define an equal number of passages 30 for distributing the vehicle 14'' onto the yarn M. Container 27 is aligned with the bottom container 8, on the other side of the partition 6, so that the fluid discharged into container 8 and not absorbed by the yarn M is collected therein and finally discharged via drain port 8' for removal and recycling.

Downstream from container 27, the yarn M is guided over tension-regulating roller means 31, over a returning means 32, through a second battery of condensers 33, and finally out of the outlet port 4 of the treating chamber. From the chamber, the yarn is fed to a pressing means 34 and, subsequently, to a washing unit (now shown).

Belt conveyor 11, on which the yarn M travels during the texturizing process, has a reticulated construction in order to facilitate its endless advancing motion and also to allow the unabsorbed vehicle to pass therethrough.

Figure 8:
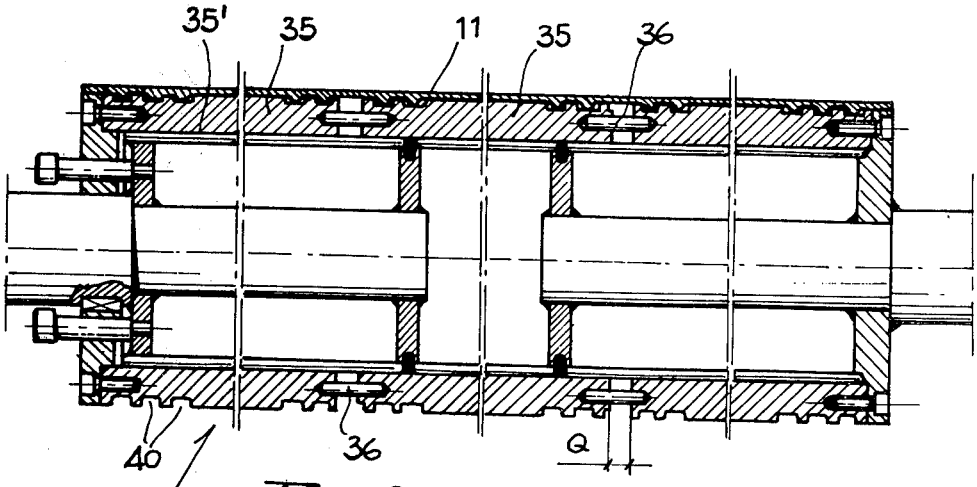
FIG. 8 is a sectional detail of the transport roller of the endless belt conveyor.

The belt conveyor is, obviously, subject to expansion and contraction due to the variations in temperature during the process. Thus, in order to have a perfect transportation of the yarn M and to maintain a perfect plane alignment, the rollers 12 of the belt conveyor consist of a plurality of tubular elements 35 (see FIG. 8) mounted in perfect alignment with one another on a cylinder 35' and provided with external throats 40 for engaging the belt.

These elements 35 are axially spaced from one another by a predetermined distance Q, and are attached to one another by means of guide means 36 so as to achieve the variations in length required by their expansion and contraction and by the expansion and contraction of the belt conveyor.

Figure 2:
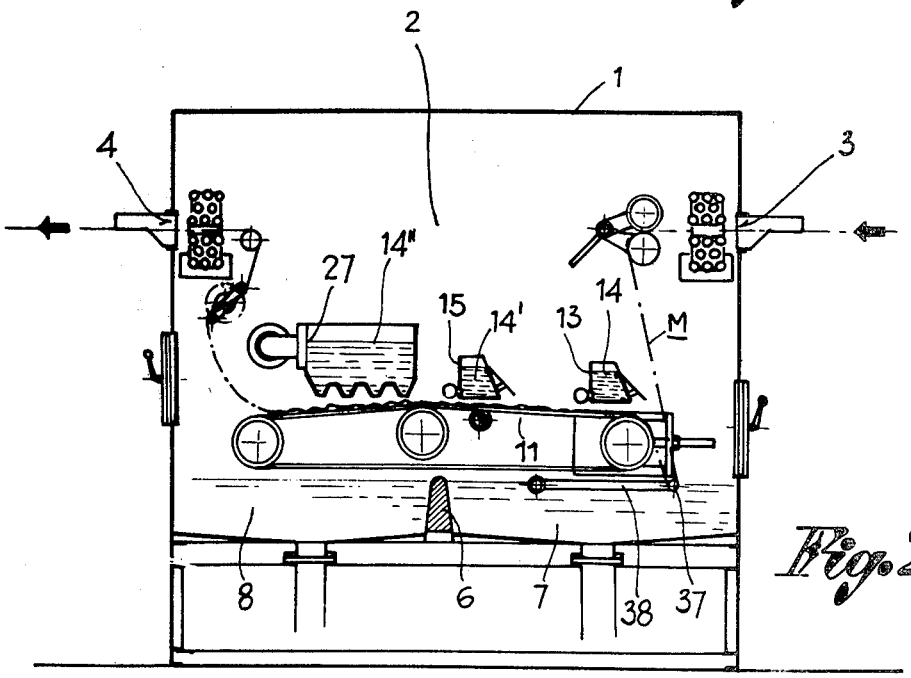
FIG. 2 is a similar view as in FIG. 1, but with reference to texturization of woven fabrics.

If, instead of a yarn, the texturization is effected on a woven fabric, the general features of the apparatus remain the same as described above, save that the fabric M (the same references numerals in FIG. 1 for the yarn are used in FIG. 2 for the woven fabric), before coming to rest on the belt conveyor 11 from the rollers 10, is transferred onto roller 37 of a pivoted lever 38 (conventional device in textiles) which is immersed in the vehicle contained in the container 7. For this purpose, only a single first container 13 is necessary and this is so positioned as to discharge its vehicle 14 onto the fabric in approximate correspondence of the area where the fabric is conveyed about the roller 37 of the pivoted lever 38.

For example, a cycle of the texturization process, using the apparatus of the present invention, may be summarized as follows: the material M (yarn or fabric), originating from previous impregnating and pressing operations (not shown), is introduced into chamber 2 and, aided by rollers 10, is moved toward belt conveyor 11 by simple gravity so as to be subjected only to a tension force created by the weight of the material. Before resting on the belt conveyor 11, the material M is impinged upon by the hot liquid vehicle 14 contained in the container or containers 13. The material M is thus heated to the texturizing temperature, which varies depending on the type of synthetic fibers contained therein. After heating, the material M, while moving on the belt conveyor, is subjected to a pre-cooling operation by the liquid vehicle 14' of container 15, followed by a cooling operation to about 60° C to about 70° C by the liquid vehicle 14'' of container 27. The successive heating, pre-cooling and cooling steps result in the desired stabilized texturization of the material M. After exiting from outlet port 4, the material is completely cooled and then passed to the subsequent phases of operation, i.e. washing, rinsing etc. conventionally known.

What I claim is:

1. Apparatus for texturizing yarn and textile fabrics containing thermo-sensitive synthetic fibers, comprising:

(a) a treating chamber having inlet and outlet ports therein for the material to be treated;

(b) first condensing means near said inlet port for condensing vapors generated in said chamber;

(c) at least one first pair of rollers near said first condensing means for guiding said material;

(d) an endless belt conveyor in said chamber for supporting and conveying said material in said chamber;

(e) at least one first container for a hot liquid vehicle for treating said material, disposed above said belt conveyor and having inlet and outlet for said vehicle;

(f) at least one second container for cold liquid vehicle for free-cooling said material and having inlet and outlet for said vehicle;

(g) a third container for cold liquid vehicle for cooling further said material and having inlet and outlet for said vehicle;

(h) a bottom container with a plurality of drain ports for collecting and discharging said vehicle discharged from said first, second and third containers;

(i) at least one second roller means for transporting said material from said belt conveyor to said outlet port of said chamber; and (j) a second condensing means near said second pair of rollers and said outlet port of said chamber for preventing vapors from exiting therefrom.

2. The apparatus of claim 1, wherein said first and second containers are channel-shaped vats.

3. The apparatus of claim 1, wherein said bottom container is provided with an intermediate divider vertically positioned on the floor of said container.

4. The apparatus of claim 3, wherein said bottom container has a drain port on each side of said vertical divider for removal of liquid vehicles discharged from the first, second and third containers.

5. The apparatus of claim 1, wherein said first and second containers have a channel-like body which is upwardly narrowing and contains therein at least one break-water divider horizontally positioned and a drop-off surface on the outside of which there is an angularly adjustable inclined plate having a curved upper terminal which rests on the upper edge of said drop-off surface.

6. The apparatus of claim 5, wherein said inclined plate of said container is adjustable angularly by means of adjustable fasteners attached to said container and movably contacting said inclined plate.

7. The apparatus of claim 1, wherein said first containers are two and are positioned parallel to each other on opposed sides of said material and are adjustably movable by mechanical means toward and away from each other.

8. The apparatus of claim 7, wherein said first containers are mounted on sliding supports connected to each other by pullers, said puller being eccentrically engaged to a disc rotating in either direction by means of geared transmission means.

9. The apparatus of claim 1, wherein said third container has a plurality of drain discharge ports and a plurality of distributing blades positioned beneath said discharge ports and transversely thereto, said blades being parallel to one another and spaced apart from one another so as to define a plurality of distribution openings for the liquid vehicle.

10. The apparatus of claim 1, wherein said belt conveyor is displaced on rollers consisting of a plurality of tubular elements mounted on a support cylinder and axially spaced from one another by a predetermined distance and connected to one another by guiding means which allow the thermal expansion and contraction of said elements and of said conveyor, said tubular elements having peripheral throats thereon for connection to said belt conveyor.

11. The apparatus of claim 1, wherein said bottom container is formed by a first and a second bottom container adjoining each other.

12. The apparatus of claim 11, wheren said belt conveyor cooperates with a pivoted lever for causing said material to become immersed in the vehicle contained in said first bottom container, said first bottom container being in fluid communication with said single first container and said single second container.

* * * * *